US008466766B2

(12) United States Patent
Carsten

(10) Patent No.: US 8,466,766 B2
(45) Date of Patent: Jun. 18, 2013

(54) INDUCTOR CORE SHAPING NEAR AN AIR GAP

(75) Inventor: Bruce W. Carsten, Corvallis, OR (US)

(73) Assignee: Peregrine Power, LLC, Wilsonville, OR (US)

( * ) Notice: Subject to any disclaimer, the term of this patent is extended or adjusted under 35 U.S.C. 154(b) by 0 days.

(21) Appl. No.: 12/707,804

(22) Filed: Feb. 18, 2010

(65) Prior Publication Data

US 2011/0199174 A1 Aug. 18, 2011

(51) Int. Cl.
*H01F 17/06* (2006.01)
*H01F 27/24* (2006.01)

(52) U.S. Cl.
USPC ..... 336/178; 336/213; 336/234

(58) Field of Classification Search
USPC ..... 336/178, 212, 165, 211, 217–218, 336/234, 213
See application file for complete search history.

(56) References Cited

U.S. PATENT DOCUMENTS 2,660,622 A * 11/1953 Field et al. ..... 360/125.01
2,761,911 A * 9/1956 Camras ..... 360/128
2,933,565 A * 4/1960 Neumann ..... 360/125.01
3,143,686 A * 8/1964 Vonderschmitt et al. ..... 315/406
3,603,864 A * 9/1971 Thaler ..... 363/48
4,599,595 A * 7/1986 Geschka ..... 336/178
5,675,306 A * 10/1997 Diaz ..... 336/178
5,694,103 A * 12/1997 Goodwin et al. ..... 336/178
6,232,865 B1 * 5/2001 Zinders et al. ..... 336/212
6,583,701 B2 6/2003 Sun
6,597,271 B2 * 7/2003 Busletta et al. ..... 336/178
2010/0171580 A1 * 7/2010 Abe et al. ..... 336/178

OTHER PUBLICATIONS

Y. Chung et al. Effect of Eddy Current in the Laminations on the Magnet Field. Advanced Photon Source, Argonne National Laboratory. LS Note No. 200. Apr. 1992.
Reuben Lee. Electronic Transformers and Circuits: Filter Inductor Design. Sep. 18, 2007.
Håkan Skarrie. Design of Powder Core Inductors. Lund University, Sweden. 2001.

* cited by examiner

*Primary Examiner* — Mohamad Musleh
*Assistant Examiner* — Mangtin Lian
(74) *Attorney, Agent, or Firm* — Steven J. Sullivan

(57) ABSTRACT

An inductor core device, and method of forming same, that has at least a first inductor core section and typically has a second inductor core section, both formed of stacked layers of conductive material. The second core section may be positioned relative to the first core section to define an air gap therebetween and the sections are preferably profiled between their respective end faces and broad surfaces to reduce the eddy current losses induced in the core section(s) near the air gap. Various embodiments, "profile" shaping configurations, and core section arrangements are disclosed.

28 Claims, 4 Drawing Sheets

INDUCTOR CORE SHAPING NEAR AN AIR GAP

FIELD OF THE INVENTION

The present invention relates to electric inductors and, more specifically, to the configuration of the core proximate an air gap in the core of these inductors.

BACKGROUND OF THE INVENTION

Inductors are used in power converters to store energy in a magnetic field during one part of an operating cycle, and to return all or part of that energy during another part of the cycle. Such inductors are typically comprised of a winding on an easily magnetized or "ferromagnetic" core. One or more so-called "air gaps" in the core are usually required to maximize the energy which can be stored in the inductor. These air gaps may be 'distributed' throughout the core, in such materials as "powdered iron" type cores, or may consist of one or more 'discrete' air gaps in the core. The faces of a discrete air gap in an inductor are conventionally flat, parallel to each other, and at right angles to the surface of the core outside the air gap.

Various inductor core materials and configurations are known in the art. These materials include silicon-steel (Si-steel) in laminated or tape wound form, ferrite, and amorphous and nanocrystalline alloys (in tape wound form), with benefits and drawbacks to each of these materials in various applications. The present invention applies to tape wound and laminated type inductor cores with one or more intentional discrete air gaps in the magnetic path, and with an alternating current (AC) in a conventional winding (not shown in figures) on the core, and the resultant AC flux in the core.

The distinction between core laminations and tape is largely based on thickness and the method of assembly. Core laminations are relatively thick, typically greater than 0.1 mm, and are stacked or assembled flat. Core tape materials are generally somewhat thinner than 0.1 mm, and are typically wound around a suitable form or mandrel to provide the desired shape.

The energy storage capability of an inductor is influenced significantly by the length of the air gap(s) in its core, there being an optimum air gap length at which the maximum core flux and winding current occur simultaneously, and where energy storage is at a maximum. A "fringe" flux field develops adjacent (but external) to such an air gap, extending from the surfaces of the core on one side of the gap to that of the other side. This fringe field is strongest at the edge of the air gap, and drops off approximately inversely with distance from the air gap.

Referring to FIG. 1A, a perspective view of a conventional inductor core 110 that illustrates this flux fringe field 150 is shown for one surface of the core. A problem associated with an ac flux fringe field is that, as noted in references [1] [2] and [3], at high frequencies and/or flux densities the fringe field 150 induces large eddy currents 117, 118 to flow on the broad surfaces 119, 120 of the tape or laminated core sections 112, 114. These eddy currents induce losses in the core near the air gap, as illustrated by the shaded regions 122 and 132 in FIG. 1*b*. These losses reduce the ability of the inductor to store and return energy at high frequencies, as the losses are proportional to the square of the induced eddy currents, and thus of both the ac flux density and the frequency. The overall result is a significantly lower allowable maximum power density (rate of energy storage and recovery) for the inductor before overheating occurs. (A similar fringe field enters the core on the edges of the tape or laminations, but this field does not induce excess eddy currents in the core.)

In the related field of Si-steel laminated core transformers, prior art attempts to reduce similar broad core surface eddy currents from the leakage flux field between primary and secondary windings entering the core are known. In this attempt, slots were made in the broad surfaces of the core laminations near the ends of the windings where the leakage flux would enter the core on the broad surface of the laminations. Application of this prior art technique to inductor cores is illustrated in FIG. 2, as taught by the inventor in [4], where slots 287 are cut into the broad surfaces of the laminated core sections 212, 214 near the air gap 226. These slots 287 'break up' the eddy currents, as shown by the eddy currents paths in phantom 227, 228, at the ends of the illustrative flux line 261, reducing their magnitude and the associated losses.

Disadvantageous aspects of this approach include that it is not readily ascertained how long, deep or frequent the slots should be, nor on how to make them. Another disadvantageous aspect is that it is difficult to cut or otherwise form slots in laminated or tape wound material without creating electrical shorts between the cut layers, which increase eddy current losses.

A need thus exists to reduce fringe field induced losses in a tape wound or laminated inductor core and, furthermore, to do so in a manner that is practical, effective, at a reasonable cost and that provides consistent and predictable results.

Ferrite and Nanocrystalline

Ferrite is a well-known inductor core material and has been one of the principal core materials of choice for frequencies above about 5 to 10 kHz due to low hysteressis and eddy current losses. Modern nanocrystalline materials, however, have lower hysteressis losses than ferrites up to about 200 kHz and can operate with 1.6 times the ac flux at 40 kHz and twice the ac flux at 20 kHz for the same loss (based on published data). Furthermore, the nanocrystalline material's saturation flux density $B_{SAT}$ is about 3 times that of ferrites at elevated temperatures of 80-100 degrees C. (1.2 Tesla v. 400 mT). Ferrite, on the other hand, has the advantage of being an isotropic ceramic material, and thus ferrite cores do not exhibit the excess eddy current losses near an air gap experienced by laminated and tape wound metallic core materials.

A need further exists to provide inductors of significantly smaller size, for example, by taking advantage of the properties of nanocrystalline material (or other similar materials yet to be developed) to improve the overall power densities of switching converters, particularly when inductor currents include dc or low frequency ac currents significantly greater than the allowable high frequency ac ripple current.

SUMMARY OF THE INVENTION

Accordingly, it is an object of the present invention to reduce or minimize eddy current losses induced in laminated or tape wound cores by the flux fringe fields near a core air gap.

It is another object of the present invention to allow inductors of smaller size and/or lower mass to be produced due to the reduced eddy current losses induced by the fringe fields near core air gaps.

In one embodiment, the present invention may include an inductor core device having at least a first inductor core section formed of stacked layers of conductive material. The first inductor core section may have an end face where, the stacked layers terminate at an air gap, a broad surface and a "profiled" transition region that extends contiguously from the end face to the broad surface.

In another embodiment, the present invention may include an inductor core device that also has a second inductor core section formed of stacked layers of conductive material. This second core section is positioned relative to the first core section to define an air gap therebetween. Each core section has a "profiled" transition region that extends from its end face to its broad surface. The profiled transition region serves to reduce eddy current losses induced by the fringe fields near core air gaps These and related objects of the present invention are achieved by use of inductor core shaping or "profiling" near an air gap as described herein.

The attainment of the foregoing and related advantages and features of the invention should be more readily apparent to those skilled in the art, after review of the following more detailed description of the invention taken together with the drawings.

DEFINITIONS

1) An "air gap" in a core is understood to be a non-magnetic portion of the core, which may consist partially or wholly of material other than air.
2) As used herein, a "core section" relates to the magnetic portion of a core near an air gap; there is a core section on each side of an air gap.
3) The "broad surface" of a core, or core section, refers to the surface substantially parallel to the greater dimension of the core's tape or lamination cross section.
4) The "broad surface" of a tape or lamination is the surface with the greater dimensions.
5) The "end face" of a core, or core portion, is that surface adjacent to a core air gap.
6) The "end face" of a core's tapes or laminations is the surface of the tape or lamination adjacent to a core air gap.
7) The "effective angle" of a profile transition region is the angle between a tangent line at the midpoint of the profiled transition region and the broad surface of the core section.

DETAILED DESCRIPTION OF THE PREFERRED EMBODIMENT

Figure 1A:
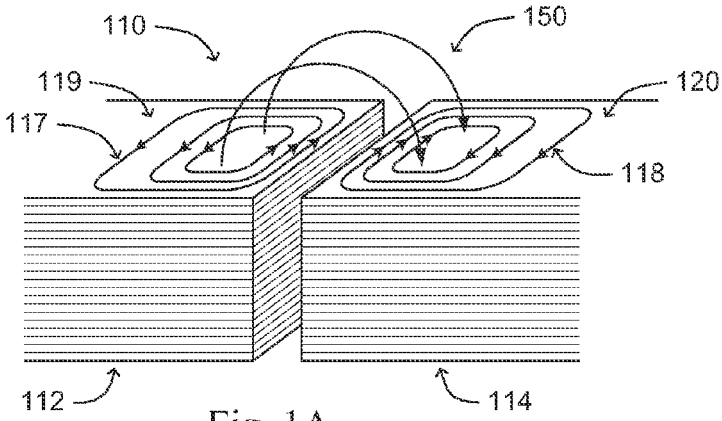
FIG. 1A is an illustration of the eddy currents induced in the broad surface of the laminations or tape in a core with an air gap.
Figure 1B:
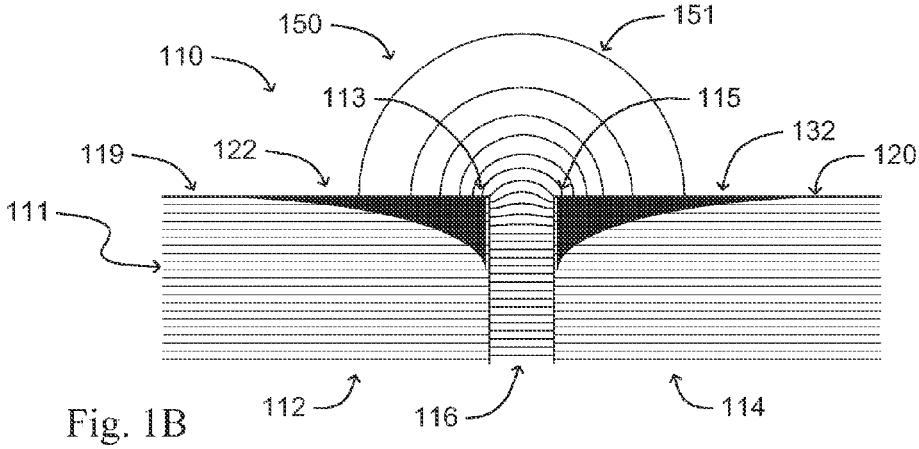
FIG. 1B is an illustration of the losses in a core due to induced eddy currents in the core.
Figure 2:
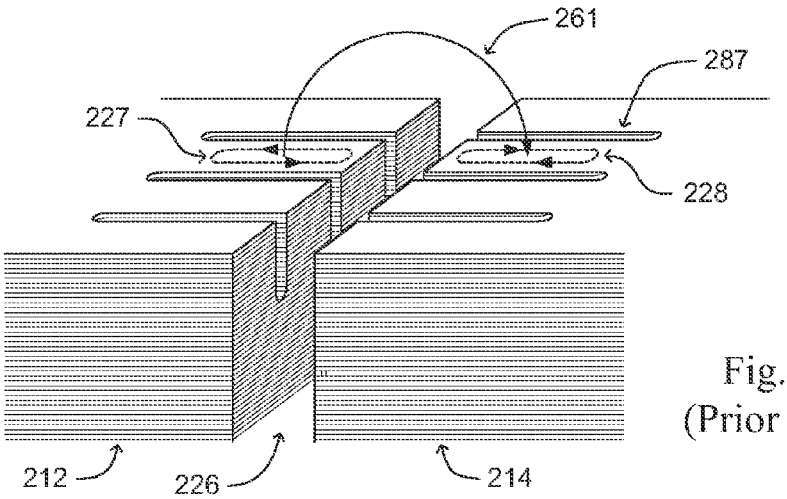
Fig. 2 (Prior Art)
FIG. 2 illustrates a prior art method of reducing the core eddy current losses adjacent to an air gap.

Referring to FIG. 1B, a side view of the air gap near one external surface of a conventional core 110 in a tape wound or laminated inductor is shown. Inductor core 110 includes a first and second section 112, 114 separated by an air gap 116. Each core section is preferably formed of alternating layers of conductive ferromagnetic and relatively thin insulative material. The conductive ferromagnetic layers 111 are shown. It is to be understood that insulating layers separate each of the conductive ferromagnetic layers to minimize eddy currents within the core itself. It is also to be understood that the conductive nature of the ferromagnetic material is an undesirable but currently unavoidable property of such materials, without which eddy current losses in the core would not be a concern.

In use, a magnetic field is produced across air gap 116 and a fringe field 150 develops near the ends of the gap. The arced lines 151 indicate the direction of this field and their increased spacing indicates a weakening of the field away from the gap. Referring back to FIG. 1A, this field forms eddy currents 117, 118 in the broad surfaces 119, 120 of the outer tape or lamination on each of the core sections 112, 114 as noted above. The eddy current in turn produces localized heating in the core sections 112, 114 as indicated by shaded areas 122, 132 in FIG. 1B. This heating is greatest at the corners 113, 115, decreasing essentially as the inverse square of the distance from the center of the air gap 116. Thus it is most important to minimize the induced eddy current losses in the core proximate to an air gap, typically for distances removed from the air gap of several times the length of the air gap.

As described above, this eddy current is disadvantageous in that it reduces the strength of the magnetic field obtainable across the gap for an allowable total power dissipation or temperature rise, and hence the ability of the inductor to store and return energy at a high rate.

Figure 3A:
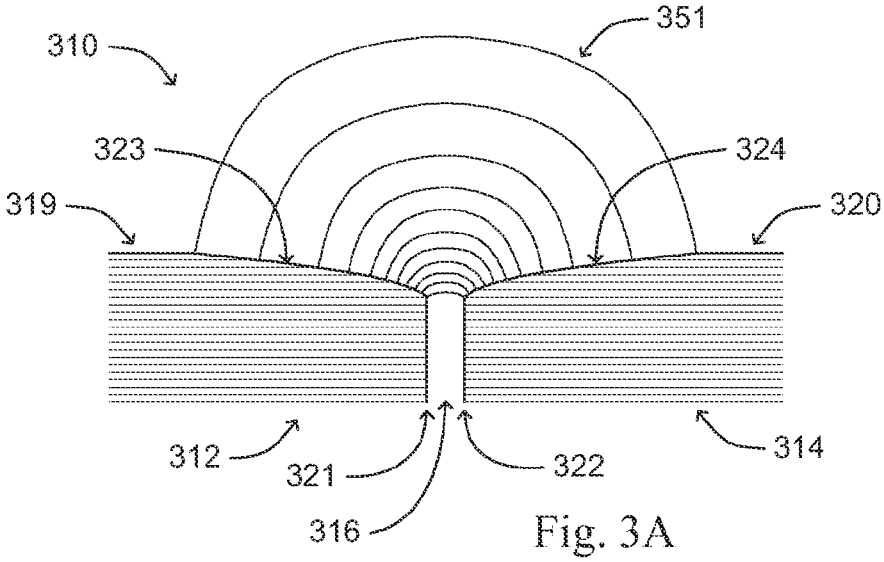
FIGS. 3A-3B are side views of an embodiment of the present invention, showing a core that is shaped near an air gap with an essentially parabolic transition profile to reduce the eddy current losses in the core from the fringe field.
Figure 3B:
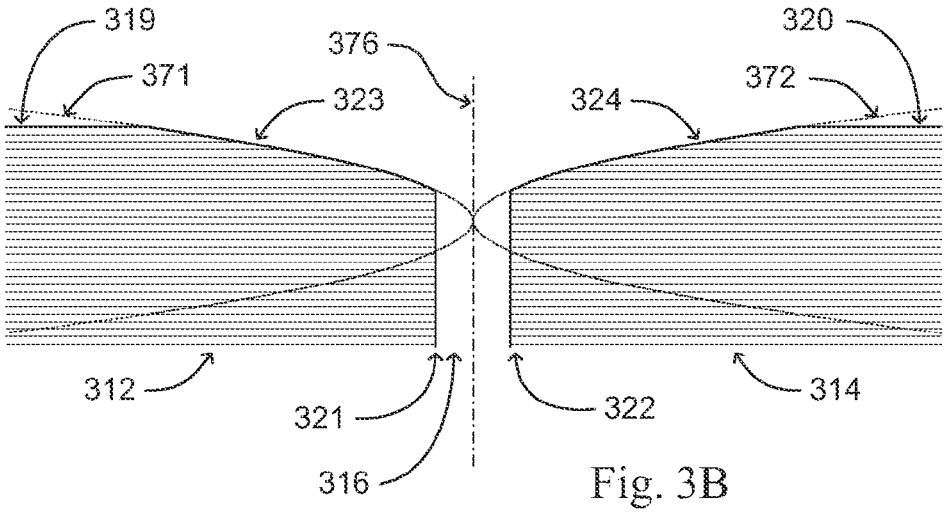

Referring to FIGS. 3A-3B, side views of an inductor core 310 in accordance with an embodiment of the present invention are shown. In core 310, the tape or laminated core sections 312, 314 have shaped transition regions 323, 324 between faces 321, 322 of air gap 316 and the broad, typically flat, surface regions 319, 320. This shaping or profiling of the core near the air gap causes the nearby fringe field, indicated by lines 351, to largely enter the tapes or laminations essentially on their end faces and not their broad surfaces, thereby minimizing eddy current losses.

Furthermore, in FIG. 3A, the transition profiles 323, 324 between the gap faces 321, 322 and the broad surfaces 319, 320 respectively, are shaped such that they approximate a parabola beginning from the center of the air gap 316. The nature of this parabolic profiling is shown more explicitly in FIG. 3B, where parabolas 371, 372 are shown in phantom lines extending outside the transition regions 323, 324 with parabola axes parallel to the broad surfaces of the tape or laminations 319, 320 and origins meeting at the center line 376 of the air gap 316.

Proximate air gap 316 in FIG. 3A the fringe field 351 flux density will decrease essentially inversely with distance from the center (376 in FIG. 3B) of the air gap 316. The said parabolic profiles 323, 324 will cause the exposed width of the core tape or laminations to increase proportionally to the distance from the center of the air gap, and thus an essentially equal flux will enter each tape or lamination at the surface exposed by the profiling. The eddy current heat generated is thus minimized and distributed at a more constant level at each tape or lamination layer.

Ideally, the profile would be such that an equal amount of flux enters each tape or lamination edge, but this is not strictly possible with a shaped or profiled transition region of finite extent. Nonetheless, as the eddy current losses before core profiling will drop off hyperbolically with distance, at least as the inverse square of the distance from the center of the air gap, a shaping or profiling extent (e.g., from the intersections of parabola 371 with surfaces 319 and 321) of even one half the gap width will remove most of the excess losses.

The parabolic transition profile illustrated in FIG. 3A is only one of many contours or shapes which may be used to significantly reduce eddy current losses in the core near an air gap. It should be recognized that while a shaping or contouring extent of approximately half the gap width removes most of the excess losses, the shaping or profiling extent may be less than half the air gap, for example, one-third or one-quarter or less without departing from the present invention. It may also be more than half the air gap.

Figure 4:
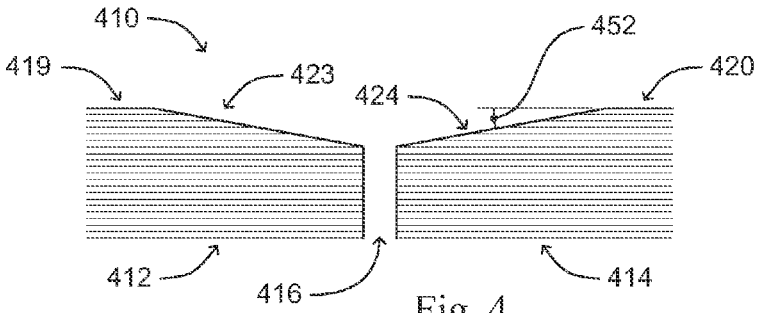
FIG. 4 is another embodiment of the present invention, showing a core shaped near an air gap with a beveled approximation to a parabolic profile to reduce the eddy current losses in the core from the fringe field.

Referring to FIG. 4, a side view of another embodiment of an inductor core 410 in accordance with a preferred embodiment of the present invention is shown. In core 410, the core sections 412, 414 are shaped in transition regions 423, 424 adjacent to air gap 416 in a beveled approximation to a parabolic profile. Such a bevel will have moderately higher losses than a more ideal profile, but the savings in fabrication costs may outweigh the increase in losses in some applications. Similar to core 310 of FIG. 3A, the beveled configuration causes the nearby fringe field to largely enter the tapes or laminations on the edge faces within the beveled region, reducing eddy current induced losses. This allows an increase in the magnetic field strength across the gap and the power density of the device.

As noted above, local eddy current losses will drop off at least as the square of the distance from the gap. This may be utilized in determining a suitable shallow angle 452 for the bevel with respect to the broad surface 420 of the core tape or laminations. This angle with the lamination or tape surface is preferably less than 45 degrees (particularly with tape wound cores), and will typically be on the order of a few degrees to 20, 30 or 35 degrees. The extent of the bevel along the core tape or lamination surface is preferably at least half the length of the air gap, and may be several times the length of the air gap to minimize most of the excess eddy current losses, with little additional benefits to longer bevels. Such bevels are not to be confused with the small bevels sometimes applied to cores to remove sharp edges. (Similar design considerations apply to the partial parabolic profile described above.)

Figure 5:
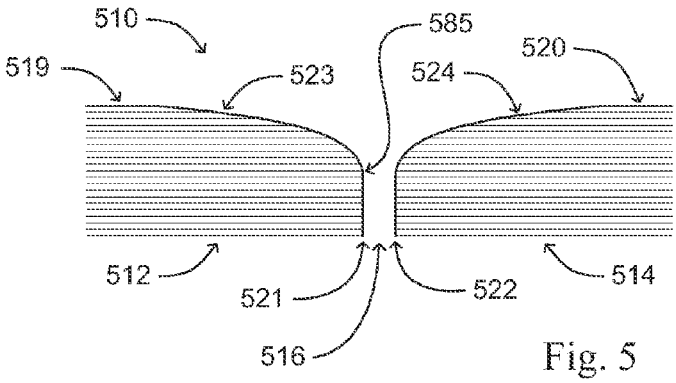
FIG. 5 is another embodiment of the present invention, showing a core shaped near an air gap with a rounded approximation to a parabolic profile to reduce the eddy current losses in the core from the fringe field.

Referring to FIG. 5, a side view of another embodiment of an inductor core 510 in accordance with a preferred embodiment of the present invention is shown. The core sections 512, 514 have rounded corners or transition shapes 523, 524 proximate to air gap 516 in an approximation to a parabolic profile. Such a rounded profile shape will have moderately higher losses than a more ideal profile shape (as in FIG. 3A), but when suitably configured will have lower losses than the beveled profile of FIG. 4.

Note that rounding or beveling of the shaped portion of a core immediately proximate to the air gap, for example at 585 in FIG. 5, where shaped portion 523 meets the core section air gap face 521, has negligible benefit in reducing eddy current losses due to the flux fringe field.

Figure 6:
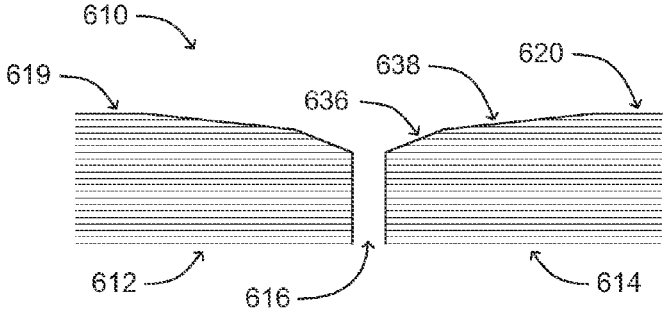
FIG. 6 is another embodiment of the present invention, showing a core shaped near an air gap with a multiply beveled approximation to a parabolic profile to reduce the eddy current losses in the core from the fringe field.

Referring to FIG. 6, a side view of another embodiment of an inductor core 610 in accordance with the present invention is shown. The core sections 612, 614 have shaped corners or transition regions consisting of two bevels, such as bevels 636, 638 in core section 614, in an approximation to the parabolic profiles 323, 324 of FIGS. 3A and 3B, or the curved profiles 523, 524 of FIG. 5. It is noted that three or more beveled regions may also be used in closer approximation to the parabolic profiles of FIG. 3 and curved profiles of FIG. 5.

It should be recognized that the principles of the invention can be used to reduce eddy current losses near an air gap when the core sections are not in the classical or conventional orientations shown in FIGS. 1-6. Three illustrative examples are shown in FIGS. 7-9.

Figure 7:
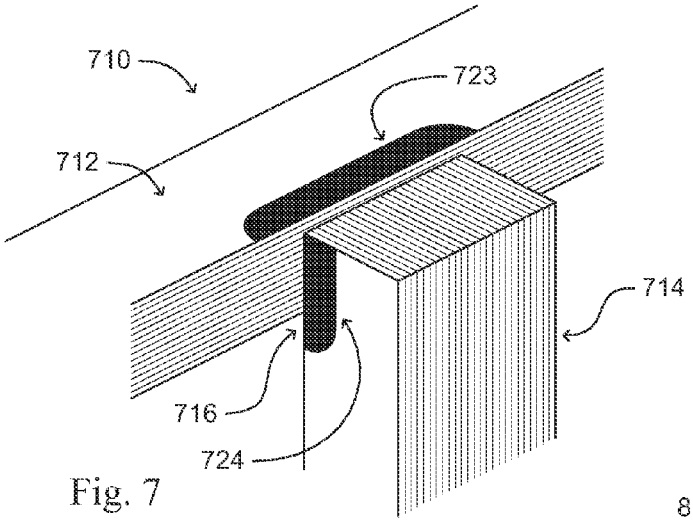
FIG. 7 is another embodiment of the present invention, showing an alternative right angle placement of the core sections, with one core section facing the side of another core section.

Referring to FIG. 7, a perspective view of another embodiment of an inductor core 710 in accordance with the present invention is shown. The core sections 712, 714 are at right angles to each other, as are the planes of the laminations or tapes in each core section. The core sections 712, 714 have shaped transitions regions shown as the shaded regions 723, 724 near air gap 716.

Figure 8:
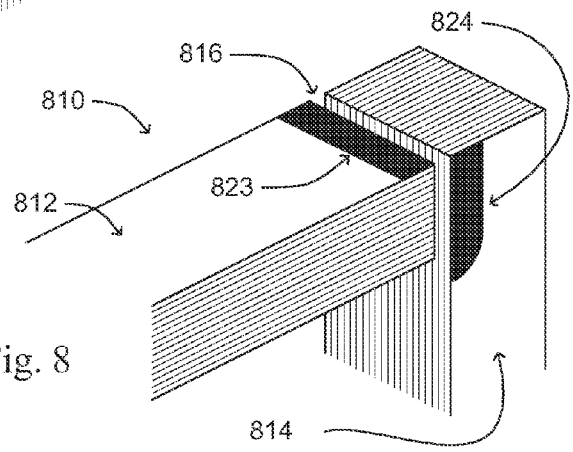
FIG. 8 is another embodiment of the present invention, showing an alternative right angle placement of the core sections, with one core section facing the end of another core section.

Referring to FIG. 8, a perspective view of another embodiment of an inductor core 810 in accordance with the present invention is shown. The core sections 812, 814 are again at a right angle to each other, but core section 814 is now at the end of core section 812 instead of on the side. The planes of the laminations or tapes in each core section are again at a right angle, although core section 812 could also be rotated 90 degrees about its long axis so that its laminations or tapes were parallel to those of core section 814 (not shown). The core sections 812, 814 have shaped transition regions shown as the shaded regions 823, 824 near air gap 816.

Figure 9:
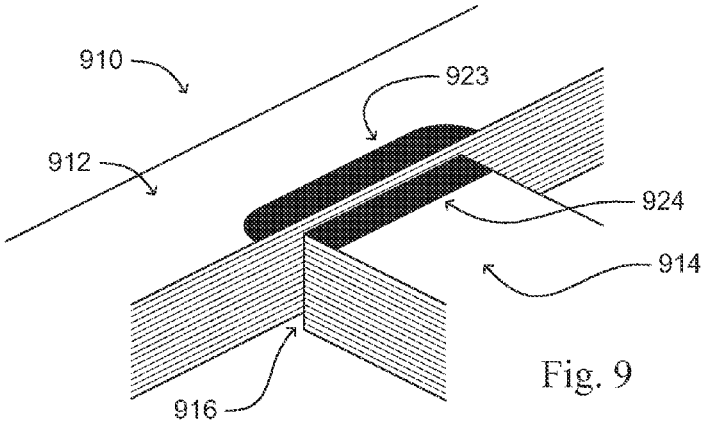
FIG. 9 is another embodiment of the present invention, showing an alternative right angle placement of the core sections, with one core section facing the side of another core section in the same plane.

Referring to FIG. 9, a perspective view of another embodiment of an inductor core 910 in accordance with the present invention is shown. The core sections 912, 914 are at a right angle to each other, and in the same plane. The planes of the laminations or tapes in core sections 912, 914 are also in the same plane, although core section 914 could also be rotated 90 degrees about its long axis so that its laminations or tapes were at a right angle to those of core section 912 (not shown). The core sections 912, 914 have shaped transitions regions shown as the shaded regions 923, 924 near air gap 916.

It should be recognized that in the embodiments disclosed in the figures, the profiled transitions from the air gap face to the broad surface of the core tape or laminations are shown on only one side of the air gap. Such core shaping should also be provided on the other side (for example, at the top and bottom of the air gap, though top and bottom are relative identifiers, the inductor core in use may be positioned at any suitable orientation). It should also be noted that in the figures the tape or lamination thickness has been exaggerated for clarity.

It should also be recognized, that while FIGS. 3-6 illustrate a profiled shape of the core sections, FIGS. 7-9 illustrate the location to be profiled but not the actual profiled shape. The shaded regions in FIGS. 7-9 (723,724, 823,824, 923,924) are preferably profiled as discussed with reference to FIGS. 3-6 or elsewhere herein.

Any of the many conventional metal-working methods might be used in profiling the cores in the current invention, including but not limited to milling, grinding, sanding, sawing, laser cutting and water jet cutting. Some of these methods may require secondary operations such as lapping and polishing to obtain a requisite smooth surface, and a final etching process may be required if primary or secondary shaping operations produce significant electrical short circuits between lamination or tape layers.

It will also be understood that the invention can be applied to inductor cores in more complex magnetic structures, including 'hybrid' or 'integrated' structures of one or more transformers and inductors. These structures include the so-called "flyback" transformer, where the transformer core contains one or more air gaps to increase energy stored in the magnetic field, effectively placing an inductance in parallel with the transformer windings. Also included are "high leakage inductance" transformers where a ferromagnetic core, with one or more air gaps, is placed between a primary and secondary winding.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features herein before set forth, and as fall within the scope of the invention and the limits of the appended claims.

References

[1] Extract from 'Filter Inductor Design' by Ruben Lee.

[2] Extract from "Design of Powder Core Inductors" by Håkan Skarrie

[3] Effect of Eddy Current in the Laminations on the Magnet Field

Y. Chung and J. Galayda, Argonne National Laboratory, Argonne, Ill. 60439

LS Note No. 200, April, 1992

[4] Extract from "High Frequency Conductor Losses in Switchmode Magnetics", B. Carsten, Seminar presented for EJ Bloom Associates, Inc., and other venues.

The invention claimed is:

1. An inductor core device, comprising:

a first inductor core section including alternating layers of conductive material and insulative material, each of the layers of conductive material having a broad surface and at least a first edge;

a second inductor core section including layers of conductive material and insulative material, each of the layers of conductive material having a broad surface and at least a first edge, the second core section being positioned relative to the first core section to define an air gap therebetween;

wherein each of the first and second core sections includes:

an end face adjacent the air gap where the first edges of a majority of the conductive material layers terminate, a core section broad surface that includes the broad surface of an exteriorly disposed one of said conductive material layers, and a profiled transition region where the first edges of a minority of the conductive material layers terminate, the profiled transition region located between and separating the end face and the core section broad surface;

wherein the profiled transition region extends from the end face to the core section broad surface in each core section.

2. The device of claim 1, wherein the end faces respectively define first and second end face planes and the distance between the first edges of the layers in the profiled transition regions from their respective end face planes increases as the distance of those layers from their respective end faces increases, as measured in the respective end face planes.

3. The device of claim 1, wherein the air gap defines a distance between the first section and the second section, and the profiled transition region of a given section extends from a plane defined by the end face towards the core section broad surface a distance of at least ¼ the air gap distance.

4. The device of claim 1, wherein the air gap defines a distance between the first section and the second section, and the profiled transition region of a given section extends from a plane defined by the end face towards the core section broad surface a distance that is equal to or more than the air gap distance.

5. The device of claim 1, wherein the core section broad surface and the end face of a given section are substantially planar, and the profiled transition region extends from the end face plane to the core section broad surface a distance that is equal to or more than the distance the profile transition region extends from the broad surface plane to the end face.

6. The device of claim 5, wherein the core section broad surface plane and the end face plane of a given section are substantially perpendicular.

7. The device of claim 5, wherein the profiled transition region extends from the end face plane to the core section broad surface a distance that is at least 1.5 times the distance the profile transition region extends from the broad surface plane to the end face.

8. The device of claim 1, wherein the end face of the first core section defines a first end face plane and the end face of the second section defines a second end face plane, and the first and second end face planes are substantially parallel.

9. The device of claim 1, wherein the effective angle of the profiled transition region from the broad surface to the end face of at least one of the first and second core sections is 35 degrees or less.

10. The device of claim 1, wherein the effective angle of the profiled transition region from the broad surface to the end face of at least one of the first and second core sections is 25 degrees or less.

11. The device of claim 1, wherein the conductive material includes nanocrystalline material.

12. An inductor core device, comprising:

a first core section including layers of conductive material, each layer having a broad surface and an edge; and a second core section including layers of conductive material, each layer having a broad surface and an edge, the second core section being positioned relative to the first core section to define an air gap therebetween;

each section having an end face in an end face plane, the respective end faces facing each other across the air gap, and a core section broad surface in a broad surface plane, the core section broad surface including an exteriorly disposed one of said conductive material layers;

wherein each core section has a transition region that extends contiguously from the end face to the core section broad surface of that core section so that the distance between the first and second sections increases continually in the transition regions such that a magnetic fringe field between the core sections substantially enters the edges of layers of the respective sections.

13. The device of claim 12, wherein the transition region of a given section is configured to have a profile that approximates, in part, a parabolic shape.

14. The device of claim 13, wherein the profile of the given section includes a curved parabolic approximation.

15. The device of claim 13, wherein the profile of the given section includes a beveled parabolic approximation.

16. The device of claim 12, wherein the air gap defines a distance between the first section and the second section, and the transition region of a given section extends from the end face plane towards the core section broad surface a distance of at least ¼ the air gap distance.

17. The device of claim 12, wherein the air gap defines a distance between the first section and the second section, and the transition region of a given section extends from the end face plane towards the core surface broad surface a distance of at least ½ the air gap distance.

18. The device of claim 12, wherein the air gap defines a distance between the first section and the second section, and the transition region of a given section extends from the end face plane towards the core surface broad surface a distance that is equal to or more than the air gap distance.

19. The device of claim 12, wherein the transition region of a given section extends from the end face plane to the core section broad surface of that section a distance that is equal to or greater than the distance the transition region extends from the broad surface plane to the end face of that section.

20. The device of claim 12, wherein the transition region extends from the end face plane to the core section broad surface a distance that is at least 1.5 times the distance the transition region extends from the broad surface plane to the end face.

21. The device of claim 12, wherein the end face planes of the first and second core sections are substantially parallel to one another and the distance between the corresponding layers in the transition regions of the respective first and second core sections increases from one another with the distance of those layers from their respective end faces, measured in the respective end face planes.

22. The device of claim 12, wherein the effective angle of the transition region from the broad surface to the end face of at least one of the first and second core sections is 35 degrees or less.

23. The device of claim 12, wherein the effective angle of the transition region from the broad surface to the end face of at least one of the first and second core sections is 25 degrees or less.

24. The device of claim 12, wherein the conductive material includes nanocrystalline material.

25. An inductor core section device, comprising:

layers of conductive material that each have a broad surface;

an end face defined by the layers of conductive material and adapted to be positioned adjacent an air gap and to face another end face across that air gap, the end face defining an end face plane;

a core section broad surface that includes the broad surface of an exteriorly disposed one of the layers of conductive material, and a profiled transition region that is positioned between and extends contiguously from the end face to the core section broad surface;

wherein a majority of the layers of conductive material terminate at the end face plane, and a minority of the layers of conductive material terminate in the profiled transition region spaced from the end face plane; and wherein the core section broad surface is substantially planar.

26. The device of claim 25, wherein the core section broad surface plane and the end face plane are substantially perpendicular; and wherein a minority of the layers of conductive material terminate in the profiled transition region, the distance from the end face plane of a given profiled transition region layer increasing with the distance of that layer from the end face.

27. The device of claim 25, wherein an air gap adjacent the end face defines an air gap distance, and the profiled transition region extends from the end face towards the core section broad surface a distance of at least ½ the air gap distance.

28. The device of claim 25, wherein the effective angle of the profiled transition region from the core section broad surface to the end face is 35 degrees or less.

* * * * *